US008106837B2

(12) United States Patent
Rahm

(10) Patent No.: US 8,106,837 B2
(45) Date of Patent: Jan. 31, 2012

(54) EQUIPMENT HOUSING WITH INTEGRAL ANTENNA

(75) Inventor: James K. Rahm, Allentown, PA (US)

(73) Assignee: General Instrument Corporation, Horsham, PA (US)

( * ) Notice: Subject to any disclaimer, the term of this patent is extended or adjusted under 35 U.S.C. 154(b) by 388 days.

(21) Appl. No.: 12/238,520

(22) Filed: Sep. 26, 2008

(65) Prior Publication Data

US 2010/0079344 A1 Apr. 1, 2010

(51) Int. Cl.
*H01Q 1/24* (2006.01)

(52) U.S. Cl. ..... 343/702; 343/772

(58) Field of Classification Search ..... 343/702, 343/700 MS, 772, 786
See application file for complete search history.

(56) References Cited

U.S. PATENT DOCUMENTS

| | | | | |
|---|---|---|---|---|
| 5,267,297 | A * | 11/1993 | Kawano et al. | 455/561 |
| 5,898,412 | A * | 4/1999 | Jones et al. | 343/872 |
| 5,986,618 | A * | 11/1999 | Aakula et al. | 343/872 |
| 6,195,050 | B1 * | 2/2001 | Kim | 343/700 MS |
| 6,388,627 | B1 * | 5/2002 | Masaki et al. | 343/702 |
| 6,437,755 | B1 * | 8/2002 | Joshi | 343/841 |
| 7,457,650 | B2 * | 11/2008 | Iwai et al. | 455/575.7 |
| 2005/0116865 | A1 * | 6/2005 | Fang et al. | 343/702 |
| 2009/0213022 | A1 * | 8/2009 | Lier et al. | 343/785 |

* cited by examiner

*Primary Examiner* — Hoanganh Le
(74) *Attorney, Agent, or Firm* — Brian G. Brannon

(57) ABSTRACT

A device comprises a housing and antenna elements. The housing has an outer surface portion and a plurality of projection portions. The projection portions dissipate heat and are disposed to extend to a first height from the outer surface portion. The antenna elements are disposed below the first height at a position of the outer surface portion and in between the projection portions. Accordingly, the antenna elements are protected by the projection portions.

12 Claims, 5 Drawing Sheets

EQUIPMENT HOUSING WITH INTEGRAL ANTENNA

BACKGROUND

Cable mesh is a relatively new type of high-capacity wireless broadband delivery system. A cable mesh network comprises a cable infrastructure (e.g., a hybrid fiber-coaxial or HFC infrastructure) and a one or more cable mesh nodes deployed at various locations and interfaced directly to the cable infrastructure.

FIG. 1 illustrates a conventional cable mesh node 100. A cable mesh node such as node 100 typically includes a cable modem that connects to an HFC network and a Wi-Fi access point (AP) installed together in a common housing or enclosure. The AP includes an antenna for connecting to the cable mesh network and for providing network access to users. As illustrated in FIG. 1, conventional cable mesh node 100 employs bolt-on antenna elements $\mathbf{102}_1$-$\mathbf{102}_n$ (hereinafter collectively referred to as "antenna elements 102") that bolt on to a housing 104 of cable mesh node 100. Antenna elements 102 are separate from housing 104. As also illustrated, a typical housing 104 contains heat-dissipating fins 106 for thermal dissipation of heat.

Cable mesh nodes such as node 100 are typically attached to elevated structures, such as poles, and are typically attached in areas of other utility services, such as high voltage electrical lines and public switched telephone network (PSTN) telephone lines. The operators of cable mesh nodes must typically negotiate access rights for placement of the cable mesh nodes and generally are confined to a defined area. A technician typically must carry the housing of the cable mesh node up a ladder and mount the housing on the pole, for example. Then, the technician typically must also mount the antenna onto the housing (and the pole), which often requires a mechanical support rod to secure the antenna. Accordingly, the size and bulkiness of the AP often makes installation of a cable mesh node difficult, time consuming and potentially hazardous, due to the potentially close proximity to high voltage electrical lines.

An improvement on the previously described conventional cable mesh node is disclosed in U.S. patent application Ser. No. 11/734,494 (the '494 application) to James Rahm, the entire disclosure of which is incorporated herein by reference. In the '494 application, and for example as illustrated here in FIG. 2, antenna elements are integrated into housing 206 of a cable mesh node 200. Housing 206 of cable mesh node 200 includes an upper half 202 and a lower half 204. The interior of upper half 202 includes beam forming electronics 208, which are electrically connected to antenna elements $\mathbf{210}_1$-$\mathbf{210}_n$ (hereinafter collectively referred to as "antenna elements 210"). Exterior to upper half 202 are a plurality of heat-dissipating fins $\mathbf{214}_1$-$\mathbf{214}_n$ (hereinafter collectively referred to as "heat-dissipating fins 214"). Antenna elements 210 are aligned with heat-dissipating fins 214 and fixed to and separated from antenna elements 210 by way of dielectric spacers 212. With this type of structure that includes antenna elements on the heating elements of the cable mesh node, no additional mechanical support is required to secure the antenna. However, as antenna elements 210 are on top of heat-dissipating fins 214, they are susceptible to damage. Further, this type of structure does not eliminate the need for additional mechanical volume in the cable mesh node.

What is needed is a cable mesh node with an integrated antenna that does not require additional mechanical volume and is less susceptible to damage.

BRIEF SUMMARY

In accordance with an aspect of the present invention a device comprises a housing and an antenna element. The housing has an outer surface portion and a projection portion. The projection portion is disposed to extend to a first height from the outer surface portion. The antenna element is disposed below the first height at a position of the outer surface portion.

Additional advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF SUMMARY OF THE DRAWINGS

The accompanying drawings, which are incorporated in and form a part of the specification, illustrate an exemplary embodiment of the present invention and, together with the description, serve to explain the principles of the invention. In the drawings.

DETAILED DESCRIPTION

Several exemplary cable mesh nodes in accordance with the present invention, for use with broadband cable television (CATV) mesh systems, will be described with reference to FIGS. 3-11.

Figure 1:
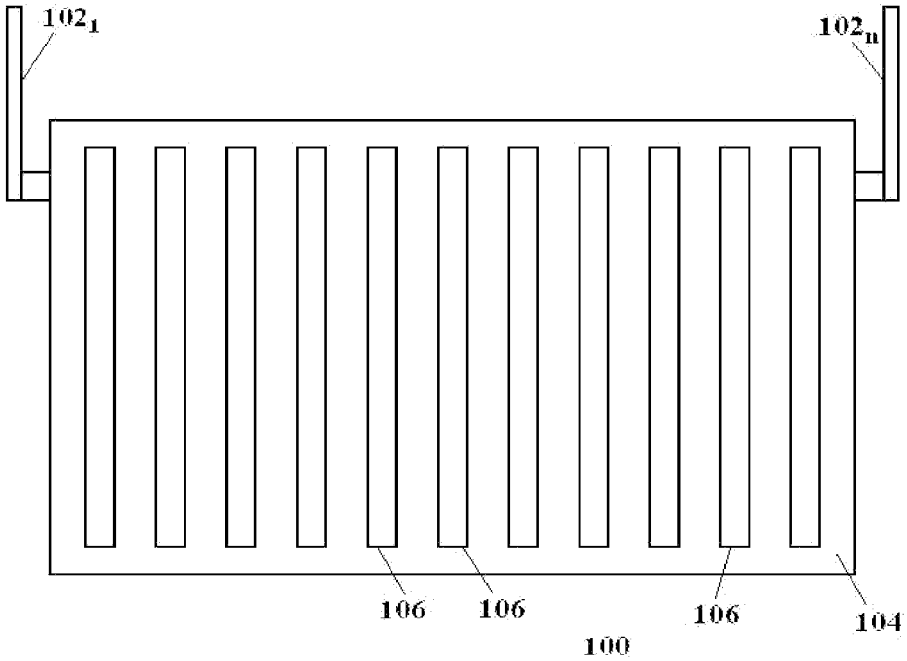
FIG. 1 (Prior Art)
FIG. 1 illustrates a plan view of a conventional cable mesh node.
Figure 2:
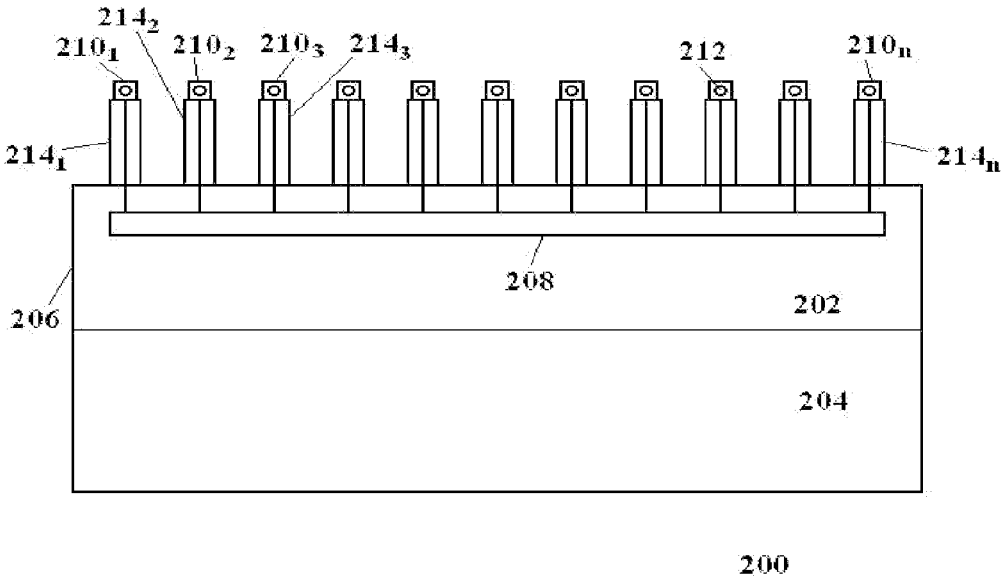
FIG. 2 (Prior Art)
FIG. 2 illustrates a cross-sectional view of a cable mesh node with an integrated antenna.
Figure 3:
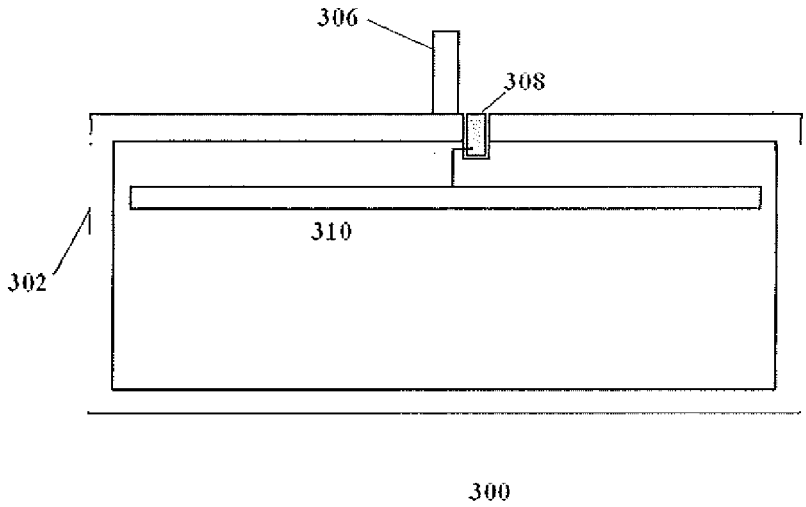
FIG. 3 illustrates a cross-sectional view of a cable mesh node having a heat-dissipating projection and an antenna element in accordance with an exemplary embodiment of the present invention.

FIG. 3 illustrates a cross-sectional view of a cable mesh node having a heat-dissipating projection and an antenna element in accordance with an exemplary embodiment of the present invention. Cable mesh node 300 includes a housing 302. Beam forming electronics 310 are disposed within housing 302. Disposed atop housing 302 is heat-dissipating projection 306. In this embodiment, heat-dissipating projection 306 is an integral part of housing 302. Set into housing 302 is antenna element 308. Specifically, in this embodiment, the upper surface of antenna element 308 is flush with the outer surface of housing 302.

The positional relationship between heat-dissipating projection 306 and antenna element 308 enables heat-dissipating projection 306 to protect antenna element 308 from damage. If, during installation or use, an object were to come into contact with cable mesh node 300, the height of heat-dissipating projection 306 above housing 302 and the fact that antenna element 308 is recessed into housing 302 results in the object impacting heat-dissipating projection 306, protecting antenna element 308.

In this embodiment, because beam forming electronics 310 only control a single antenna element, antenna element 308, they may be of very rudimentary design, e.g., an on/off switch.

Figure 4:
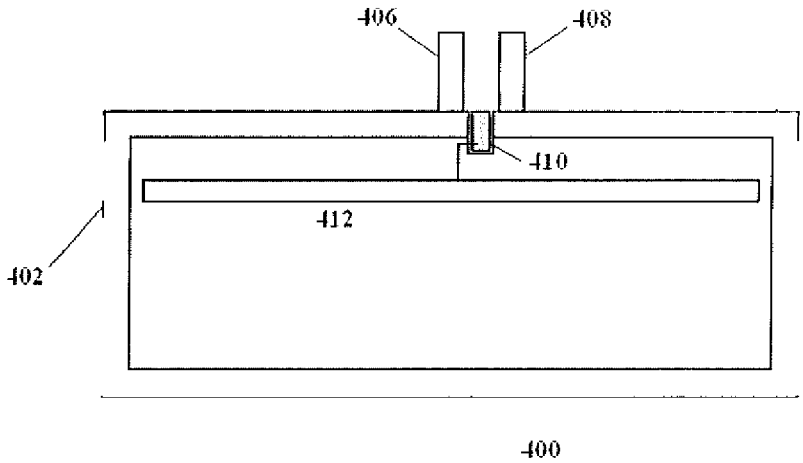
FIG. 4 illustrates a cross-sectional view of a cable mesh node having more than one heat-dissipating projection and an antenna element in accordance with another exemplary embodiment of the present invention.

FIG. 4 illustrates a cross-sectional view of a cable mesh node having more than one heat-dissipating projection and an antenna element in accordance with another exemplary embodiment of the present invention. In the figure, cable mesh node 400 includes a housing 402. Beam forming electronics 412 are disposed within housing 402. Disposed atop housing 402 are heat-dissipating projections 406 and 408. Set into housing 402 is antenna element 410.

In this embodiment, a plurality of heat-dissipating projections 406 and 408 provide better heat-dissipation than a single heat-dissipating projection, such as projection 306 as shown in FIG. 3. Further, positional relationship between heat-dissipating projections 406 and 408 and antenna element 410 enable heat-dissipating projections 406 and 408 to protect antenna element 410 from damage in a manner similar to the embodiment discussed above with respect to FIG. 3. Specifically, if, during installation or use, an object were to come into contact with cable mesh node 400, the height of heat-dissipating projections 406 and 408 above housing 402 and the fact that antenna element 410 is recessed into housing 402 results in the object impacting heat-dissipating projections 406 and 408, protecting antenna element 410. Still further, based on well known Maxwell's equations, the spacing, size, shape and material of heat-dissipating projections 406 and 408 can be chosen to optimize the performance of antenna element 410.

Similar to the embodiment discussed above with reference to FIG. 3, in this embodiment, because beam forming electronics 412 only control a single antenna element, antenna element 410, they may be of very rudimentary design, e.g., an on/off switch.

Figure 5:
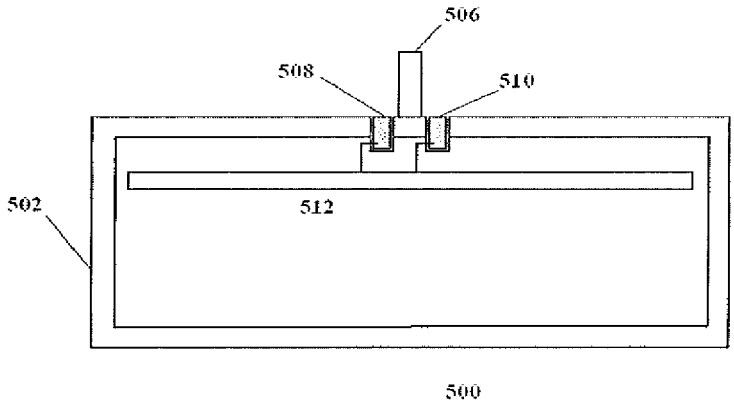
FIG. 5 illustrates a cross-sectional view of a cable mesh node having a heat-dissipating projection and more than one antenna element in accordance with another exemplary embodiment of the present invention.

FIG. 5 illustrates a cross-sectional view of a cable mesh node having a heat-dissipating projection and more than one antenna element in accordance with another exemplary embodiment of the present invention. In the figure, cable mesh node 500 includes a housing 502. The inner portion of housing 502 includes Beam forming electronics 512 are disposed within housing 502. Disposed atop housing 502 is heat-dissipating projection 506. Set into housing 502 are antenna elements 508 and 510.

In this embodiment, a plurality of antenna elements 508 and 510 allow for advanced beam shaping by beam forming electronics 512. Beam forming electronics 512 may use techniques including, but not limited to, magnitude adjustment and phase delay to steer or amplify the beam.

Similar to the embodiments discussed above, the positional relationship of heat-dissipating projection 506 and antenna elements 508 and 510 enables heat-dissipating projection 506 to protect antenna elements 508 and 510 from damage. Further, the size, shape and material of heat-dissipating projection 506 can be chosen to optimize the performance of antenna elements 410.

Figure 6:
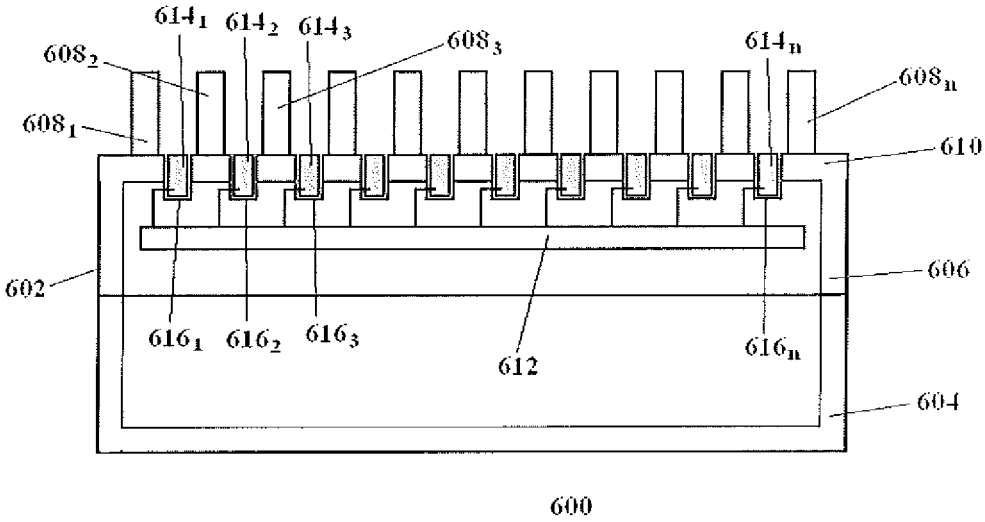
FIG. 6 illustrates a cross-sectional view of a cable mesh node having more than one heat-dissipating projection and more than one antenna element, wherein all the heat-dissipating projections have the same height, in accordance with another exemplary embodiment of the present invention.
Figure 7:
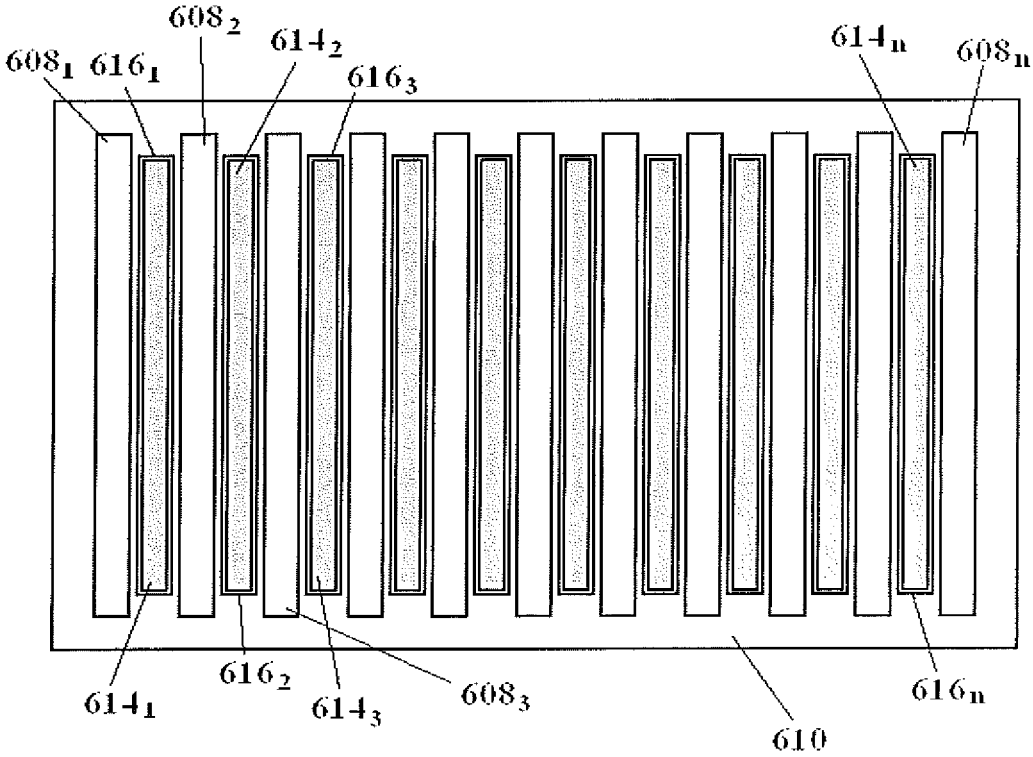
FIG. 7 illustrates a plan view of the cable mesh node of FIG. 6.

FIG. 6 illustrates a cross-sectional view of a cable mesh node having more than one heat-dissipating projection and more than one antenna element, wherein all the heat-dissipating projections have the same height, in accordance with another exemplary embodiment of the present invention. FIG. 7 illustrates a plan view of cable mesh node 600. In FIGS. 6 and 7, cable mesh node 600 includes housing 602 comprising a lower section 604 and upper section 606. In this embodiment, upper section 606 contains beam forming electronics 612, a plurality of heat dissipating projections $\mathbf{608}_1$-$\mathbf{608}_n$, and waveguide elements $\mathbf{614}_1$-$\mathbf{614}_n$. Also in this embodiment, section 606 has a portion of thicker metal 610 to increase the rigidity of housing 604.

Each of waveguide elements $\mathbf{614}_1$-$\mathbf{614}_n$ rest in one of cavities $\mathbf{616}_1$-$\mathbf{616}_n$ and are flush with the upper surface of upper section 606. In one embodiment of the present invention, each of cavities $\mathbf{616}_1$-$\mathbf{616}_n$ has a corresponding waveguide element $\mathbf{614}_1$-$\mathbf{614}_n$. In other embodiments, some of cavities $\mathbf{616}_1$-$\mathbf{616}_n$ may be empty or the associated waveguide element $\mathbf{614}_1$-$\mathbf{614}_n$ may be non-radiating.

Figure 8:
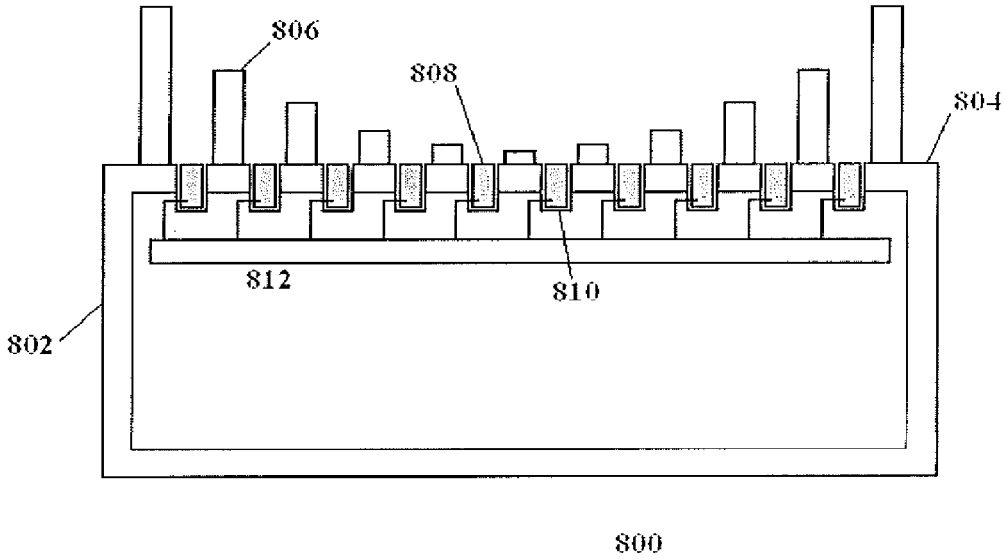
FIG. 8 illustrates a cross-sectional view of a cable mesh node having more than one heat-dissipating projection and more than one antenna element, wherein all the heat-dissipating projections do not have the same height, in accordance with another exemplary embodiment of the present invention.

FIG. 8 illustrates a cross-sectional view of a cable mesh node having more than one heat-dissipating projection and more than one antenna element, wherein all the heat-dissipating projections do not have the same height, in accordance with another exemplary embodiment of the present invention. In the figure, cable mesh node 800 includes housing 802 having outer portion 804. The inner portion of housing 802 includes beam forming electronics 812. Disposed atop outer portion 804 is a plurality of heat-dissipating projections 806, wherein some of plurality of heat-dissipating projections 806 extend to different heights above outer portion 804. Set into outer portion 804 are antenna elements 808.

This embodiment illustrates that heat-dissipating projections 806 are not equal in height. These height differences may be determined to provide specific heat transfer characteristics in addition to meeting specific volume requirements for a particular cable mesh node. Further, the spacing, size, shape and material of heat-dissipating projections 806 can be chosen to optimize the performance of antenna elements 808.

Figure 9:
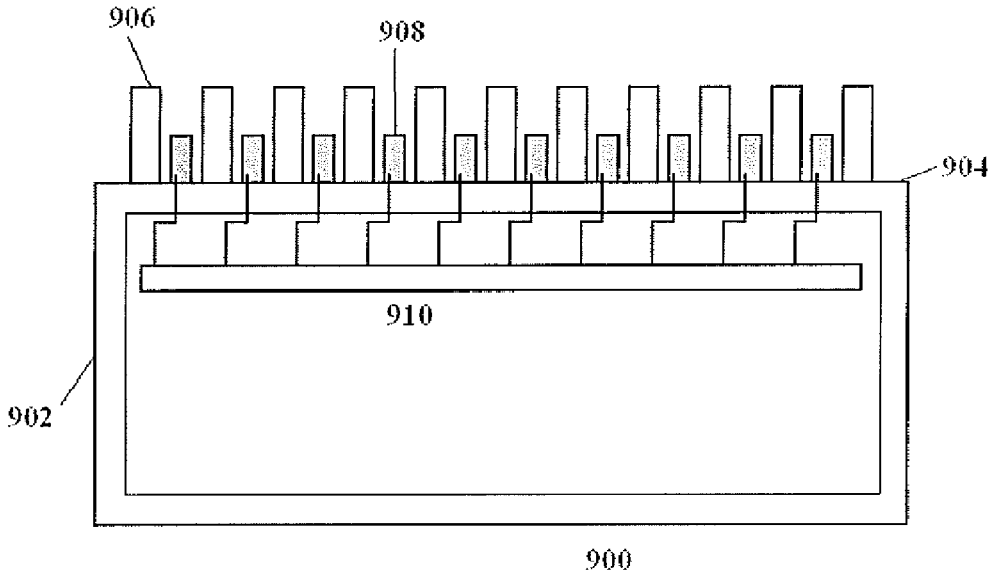
FIG. 9 illustrates a cross-sectional view of a cable mesh node having more than one heat-dissipating projection and more than one antenna element, wherein all the antenna elements are disposed on an outer portion of the housing, in accordance with another exemplary embodiment of the present invention.

FIG. 9 illustrates a cross-sectional view of a cable mesh node having more than one heat-dissipating projection and more than one antenna element, wherein all the antenna elements are disposed on an outer portion of the housing, in accordance with another exemplary embodiment of the present invention. In the figure, cable mesh node 900 includes housing 902 having outer portion 904. The inner portion of housing 902 contains beam forming electronics 910. Disposed atop outer portion 904 is a plurality of heat-dissipating projections 906.

In this embodiment, antenna elements 908 are disposed on top of outer portion 904. The positional relationship between heat-dissipating projections 906 and antenna elements 908 enables heat-dissipating projections 906 to protect antenna elements 908 from damage, in a manner similar to the embodiments discussed above. Further, the spacing, size, shape and material of heat-dissipating projections 906 can be chosen to optimize the performance of antenna elements 908. Additionally, in contrast to the embodiment illustrated in FIG. 7, having antenna elements 908 on top of outer portion 904 may result in simpler manufacturing of cable mesh node 900 or may allow outer portion 904 to be thinner while still maintaining the desired rigidity of housing 902.

Figure 10:
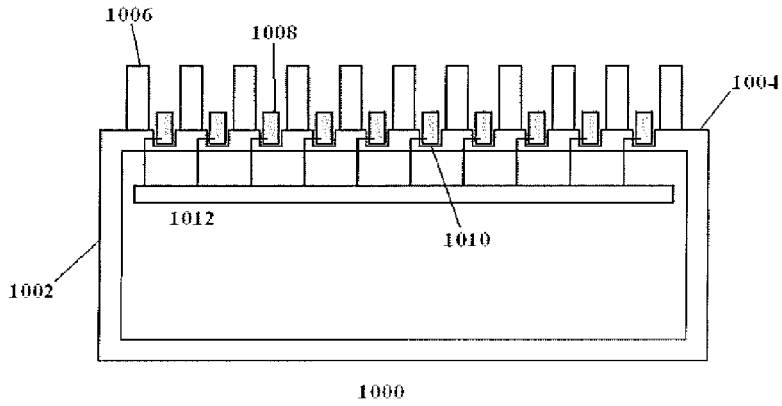
FIG. 10 illustrates a cross-sectional view of a cable mesh node having more than one heat-dissipating projection and more than one antenna element, wherein all the antenna elements are disposed in an outer portion of the housing, in accordance with another exemplary embodiment of the present invention.

FIG. 10 illustrates a cross-sectional view of a cable mesh node having more than one heat-dissipating projection and more than one antenna element, wherein all the antenna elements are disposed partially within an outer portion of the housing, in accordance with another exemplary embodiment of the present invention. In the figure, cable mesh node 1000 includes housing 1002 having outer portion 1004. The inner portion of housing 1002 includes beam forming electronics 1012. Disposed partially within outer portion 1004 is a plurality of heat-dissipating projections 1006, the plurality of heat-dissipating projections 1006 extending different heights above outer portion 1004.

In this embodiment, antenna elements 1008 are disposed partially within outer portion 1004 so as not to be flush. The positional relationship between heat-dissipating projections 1006 and antenna elements 1008 enables heat-dissipating projections 1006 to protect antenna elements 1008 from damage in a manner similar to the embodiments discussed above. Further, the spacing, size, shape and material of heat-dissipating projections 1006 can be chosen to optimize the performance of antenna elements 1008. Additionally, in contrast to the embodiment illustrated in FIG. 7, having antenna elements 1008 disposed partially within outer portion 1004 may allow outer portion 1004 to be thinner while still maintaining the desired rigidity of housing 1002. Further, in contrast to the embodiment illustrated in FIG. 9, having antenna elements 1008 disposed partially within outer portion 1004 may provide more rigidity of antenna elements 1008.

Figure 11:
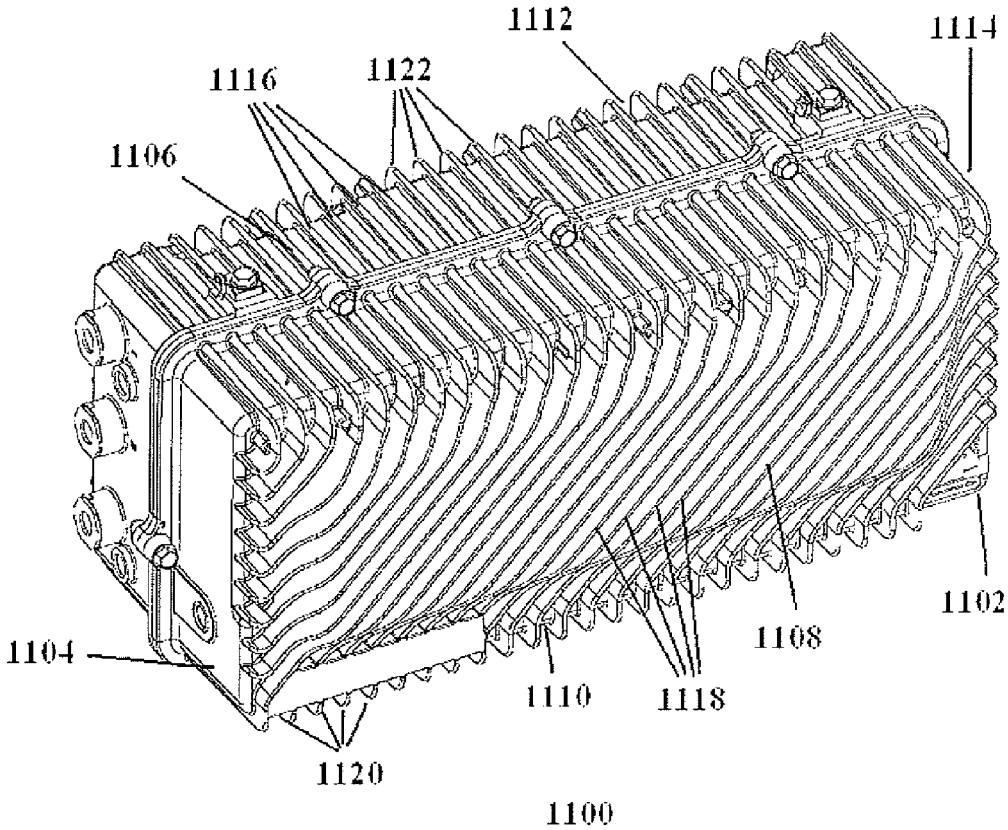
FIG. 11 is an oblique view of a cable mesh node in accordance with another exemplary embodiment of the present invention.

FIG. 11 is an oblique view of a cable mesh node 1100 in accordance with another exemplary embodiment of the present invention. Housing 1102 of cable mesh node 1100 includes a left side 1104, a top side 1106, a front side 1108, a bottom side 1110, a back side 1112 and a right side 1114. Heat-dissipating projections 1116 extend from top side 1106 and are parallel to left side 1104 and right side 1114. Heat-dissipating projections 1118 extend from fronts side 1108 and are shown at an angle. Heat-dissipating projections 1120 extend from bottom side 1110 and are parallel to left side 1104 and right side 1114. Heat-dissipating projections 1122 extend from 1112 and are angled similar to heat-dissipating projections 1118. As shown, the heat-dissipating projections may be on any side of the housing and may be positioned at varied angles with respect to the housing.

Antenna elements may be disposed in housing 1102 in accordance with the present invention in any combination of the embodiments discussed above. Further, such antenna elements may be combined with one or a plurality of beam forming electronics to customize beam steering characteristics.

In the embodiments discussed above, the antenna elements have a rectangular shape. In other embodiments, the antenna elements may have a different shape including, but not limited to, an elliptical shape. Any shape may be used to provide desired wave propagation parameters.

In the embodiments discussed above that have more than one antenna element, all the antenna elements within a single cable mesh node have the same shape. In other embodiments, the antenna elements of a single cable mesh node may have different shapes.

In the embodiments discussed above, the antenna elements may be adapted to emit linearly or circularly polarized electromagnetic waves.

In the embodiments discussed above, the heat-dissipating projections are shown as fins. In other embodiments, the heat-dissipating projections may have different shapes, non-limiting examples of which include spikes, or elongated dashed portions having a width wider than a spike but narrower than a fin as illustrated for example in FIG. 7.

In the embodiments discussed above, each antenna element may be an open-ended waveguide that may comprise a hollow metal outer portion filled with one or more dielectric substances. Any known dielectric substance or combination of dielectric substances may be used to fill the hollow metal outer portion to provide desired waveguide properties. A non-limiting example of a dielectric substance includes air. If the dielectric substance, or combination of dielectric substances, is other than air, the antenna elements are more resistant to environmental damages, a non-limiting example of which includes impact.

In the embodiments discussed above, the waveguide elements are illustrated as a one-dimensional array that are aligned horizontally and spaced by heat-dissipating projections, for example as illustrated in FIG. 7. In other embodiments, the waveguide elements comprise an n-dimensional array wherein a plurality of spaced waveguide elements are aligned vertically in addition to the horizontal alignment as illustrated in FIG. 7. In these other embodiments, any number of waveguide elements may be spaced vertically to provide desired wave propagation parameters.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The exemplary embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. A device comprising:

a housing having an outer surface portion and a projection portion, said projection portion being disposed to extend to a first height from said outer surface portion;

an antenna element disposed below the first height at a position of the outer surface portion;

a second projection portion disposed to extend to a second height from said outer surface portion, a second antenna element disposed below the first height at a second position of said outer surface portion, wherein said antenna element and said second antenna element are disposed in a position flush with said outer surface portion.

2. The device of claim 1, wherein said antenna element comprises an open-ended waveguide.

3. The device of claim 2, wherein said open-ended waveguide has a rectangular cross-sectional shape.

4. The device of claim 3, wherein said open-ended waveguide comprises a hollow metal outer portion and a dielectric inner portion disposed within said hollow metal outer portion.

5. The device of claim 1, wherein the first height is not equal to the second height.

6. The device of claim 1, wherein the first height is equal to the second height.

7. A device comprising:

a housing having an outer surface portion and a projection portion, said projection portion being disposed to extend to a first height from said outer surface portion;

an antenna element disposed below the first height at a position of the outer surface portion;

wherein said projection portion is a heat dissipation element configured to dissipate heat from within said housing.

8. The device of claim 7, wherein said housing includes a plurality of projection portions with the antenna element disposed therebetween.

9. The device of claim 8, wherein the plurality of projection portions form an open-ended waveguide.

10. The device of claim 9, wherein said open-ended waveguide has a rectangular cross-section shape.

11. The device of claim 7, wherein the antenna element is disposed on said outer surface portion.

12. The device of claim 7, wherein the antenna element is recessed in said outer surface portion.

* * * * *